US011835233B2

(12) United States Patent
Fildes et al.

(10) Patent No.: US 11,835,233 B2
(45) Date of Patent: Dec. 5, 2023

(54) FLAME SENSING FOR OIL BURNER

(71) Applicant: R.W. Beckett Corporation, North Ridgeville, OH (US)

(72) Inventors: Christopher Allen Fildes, North Ridgeville, OH (US); Benjamin Scott Anderson, North Ridgeville, OH (US)

(73) Assignee: R.W. Beckett Corporation, North Ridgeville, OH (US)

( * ) Notice: Subject to any disclaimer, the term of this patent is extended or adjusted under 35 U.S.C. 154(b) by 240 days.

(21) Appl. No.: 17/324,264

(22) Filed: May 19, 2021

(65) Prior Publication Data

US 2022/0373179 A1 Nov. 24, 2022

(51) Int. Cl.
*F23N 5/24* (2006.01)

(52) U.S. Cl.
CPC ..... *F23N 5/242* (2013.01); *F23N 2223/14* (2020.01); *F23N 2227/20* (2020.01); *F23N 2229/22* (2020.01)

(58) Field of Classification Search
CPC ..... F23N 229/04; F23N 2229/20
See application file for complete search history.

(56) References Cited

U.S. PATENT DOCUMENTS 4,157,506 A * 6/1979 Spencer ..... G01R 23/15 340/577
5,107,128 A * 4/1992 Davall ..... F23N 5/082 250/226
7,229,278 B1 6/2007 Newberry
7,255,285 B2 * 8/2007 Troost ..... F23N 5/242 236/91 B
8,430,666 B1 * 4/2013 Clevenger ..... F23N 5/08 431/12
9,335,046 B2 * 5/2016 Kraemer ..... F23N 5/082
9,388,984 B2 7/2016 Anderson
2008/0266120 A1 * 10/2008 Leeland ..... F23N 5/242 340/578
2011/0151387 A1 * 6/2011 Greene ..... F23N 5/203 431/66
2021/0356126 A1 * 11/2021 Zink ..... F23N 5/242

* cited by examiner

*Primary Examiner* — Avinash A Savani

(74) *Attorney, Agent, or Firm* — Eschweiler & Potashnik, LLC

(57) ABSTRACT

Methods, systems, and circuitries are provided for detecting flame in a fuel oil burner. In one example, a method includes receiving a series of one or more light samples, each indicative of a level of light. When the fuel oil burner is operating in the flame expected mode, the method includes determining whether the values of the one or more of the light samples exceed a flame threshold; determining whether the values of the one or more of the light samples meet secondary criteria; determining that a flame is present when the values of the one or more light samples exceed the flame threshold and meet the secondary criteria; and determining that a flame is not present when the values of the one or more light samples are below the flame threshold or do not meet the secondary criteria.

18 Claims, 5 Drawing Sheets

FLAME SENSING FOR OIL BURNER

FIELD

The present disclosure relates to the field of fuel oil burners and in particular to techniques for sensing flame in fuel oil burners.

BACKGROUND

Legacy fuel oil burners are designed to burn fossil fuels. There is increasing demand for fuel oil burners that can operate using alternative or renewable fuels.

BRIEF DESCRIPTION OF THE DRAWINGS

Some examples of circuits, apparatuses and/or methods will be described in the following by way of example only. In this context, reference will be made to the accompanying Figures.

DETAILED DESCRIPTION

Figure 1:
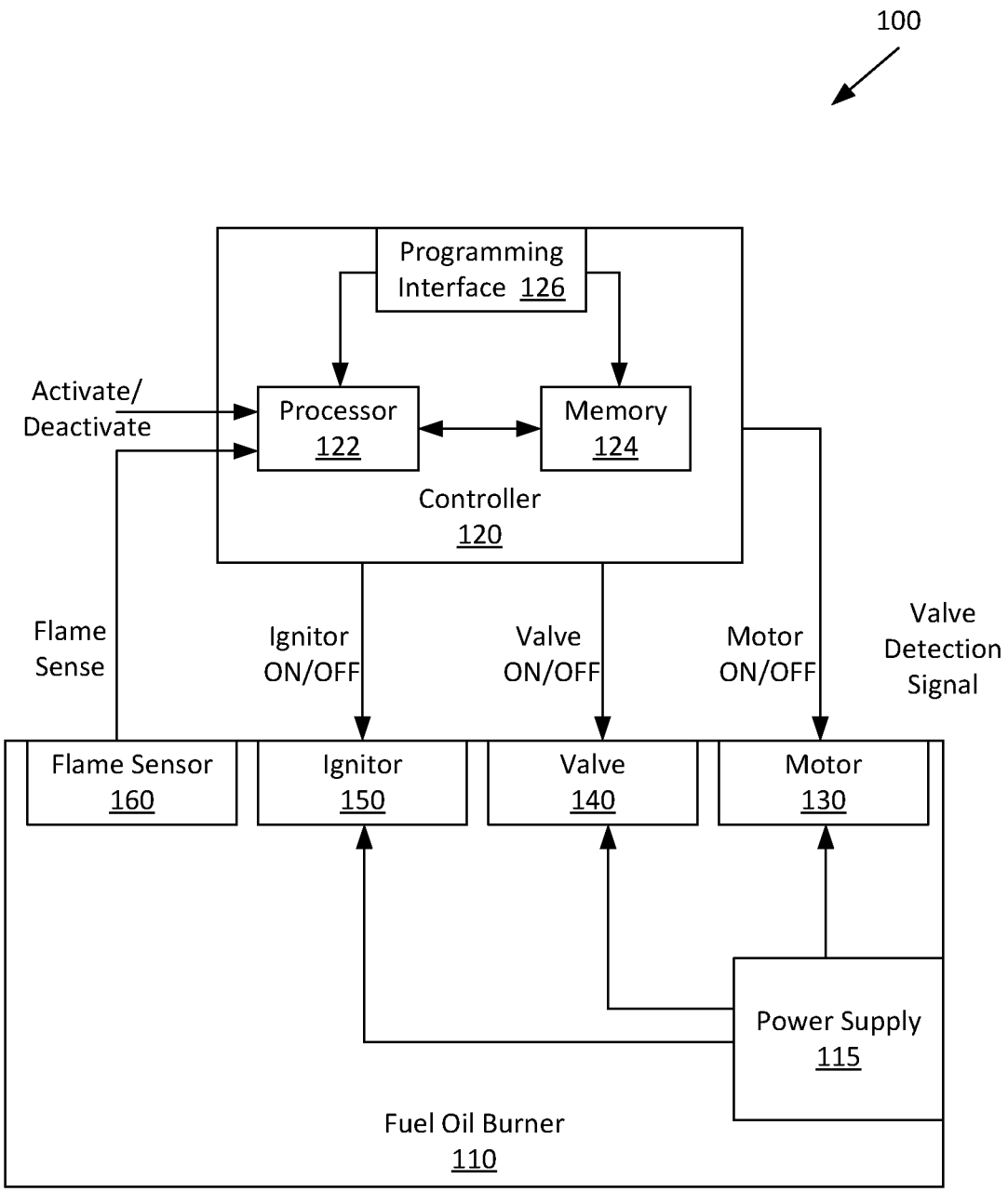
FIG. 1 is a block diagram of an exemplary fuel oil burner control system, in accordance with various aspects described.

FIG. 1 is a block diagram of an exemplary fuel oil burner system 100 that includes a fuel oil burner 110 and a controller 120. The fuel oil burner 110 includes a power supply 115 that provides regulated power to a motor 130, an oil valve 140, and an ignitor 150. The motor 130 drives a blower or fan (not shown) that moves air into a combustion chamber (not shown) containing air or other medium being heated by the fuel oil burner. The motor 130 may also drive a fuel oil pump (not shown) that pumps fuel oil to the valve 140.

The oil valve 140 controls flow of fuel oil to a nozzle (not shown) that atomizes the fuel for optimal combustion. For the purposes of this description the term "valve" will be used interchangeably with "oil valve" to refer to a separate oil valve as contrasted with an internal valve in a fuel oil pump. The valve 140 is controlled to operate in either an ON (fuel oil flowing to nozzle) or OFF (no fuel oil flowing to nozzle) mode. The valve 140 may be controlled with an electrical or electronic signal (supplied by the power supply 115) that, when provided to the valve, moves/maintains the valve in the ON mode. The absence of this "valve ON" signal may cause the valve to operate in the OFF mode.

The ignitor 150 is energized to provide a spark to ignite fuel oil being sprayed by the nozzle. Once the fuel oil is ignited, the ignitor 150 may be de-energized. A flame sensor 160 generates a flame sense signal that is indicative of whether a flame is present within the combustion chamber. Flame sense signals may be related to an amount of ultraviolet, visible, or infrared light that is present within the combustion chamber, the presence of gaseous combustion byproducts, and/or the temperature of the combustion chamber. One example flame sensor is a light sensitive cadmium sulfide (CAD) cell that exhibits a resistance that decreases as a level of ambient light increases. When the flame sensor 160 includes a CAD cell the flame sense signal may depend (e.g., have a voltage/current magnitude that is dependent upon) the resistance of the CAD cell. During operation of the fuel oil burner system (including both ON and OFF cycles) the controller 120 determines whether or not a flame is sensed. The controller will activate a failsafe feature when a flame is sensed when none is expected or when no flame is sensed when a flame is expected.

The controller 120 controls operation of the fuel oil burner 110 in response to an activation signal that is generated by a thermostat or other system that determines whether heat from fuel oil burner is desired. The controller 120 includes a processor 122 and a computer-readable medium or memory 124. The memory 124 stores computer-executable instructions that, when executed by the processor 122, cause the process to perform corresponding operations for processing input signals such as the activation signal and the flame sense signal and in response providing control signals to the fuel oil burner 110. The memory 124 may also store parameter values that control various aspects of operation of the controller 120. For example, the memory 124 may store a value for a flame detection period or values for various parameters used in flame detection. A programming interface 126 allows an external user to modify values stored in the memory 124 and/or operational settings of the processor. The programming interface 126 may be designed in accordance with an industry standard communication protocol.

Following are several flow diagrams outlining example methods. In this description and the appended claims, use of the term "determine" with reference to some entity (e.g., parameter, variable, and so on) in describing a method step or function is to be construed broadly. For example, "determine" is to be construed to encompass, for example, receiving and parsing a communication that encodes the entity or a value of an entity. "Determine" should be construed to encompass accessing and reading memory (e.g., lookup table, register, device memory, remote memory, and so on) that stores the entity or value for the entity. "Determine" should be construed to encompass computing or deriving the entity or value of the entity based on other quantities or entities. "Determine" should be construed to encompass any manner of deducing or identifying an entity or value of the entity.

Figure 2:
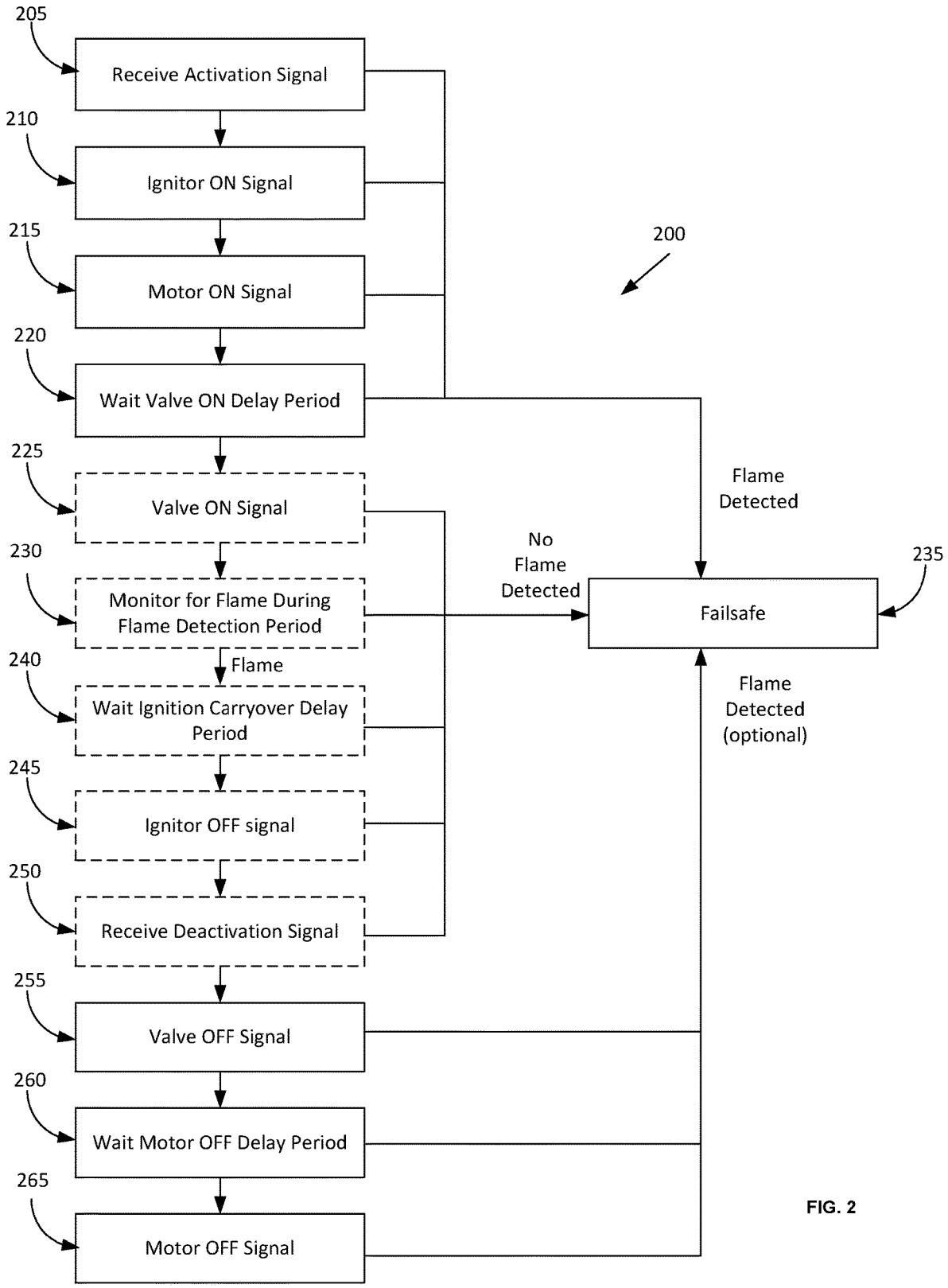
FIG. 2 is a flow diagram outlining an exemplary fuel oil burner control method, in accordance with various aspects described.

FIG. 2 outlines an exemplary burner control method 200 that may be performed by the controller 120. In the background of the control method 200 the controller 120 continuously monitors for flame based on the flame sense signal. To detect flame the controller receives flame sense signal samples taken at a sampling frequency over consecutive sampling intervals and determines whether a flame is present based on the values of the samples. The term flame detection signal will be used herein as shorthand for one or more flame sense signal samples.

During some phases of operation (shown in solid line) the controller does not expect flame and applies a first set of criteria to the flame sense signal to detect flame. When flame is detected during one of these "NO FLAME" periods, the controller activates a failsafe feature 235. During other phases of operation (shown in dashed line) the controller expects flame and applies a second set of criteria to the flame sense signal to detect flame. When flame is not detected during one of these "FLAME" periods, the controller activates the failsafe feature 235. In one example, different failsafe features are activated for when an unexpected flame is detected versus when expected flame is not detected. The first and second sets of criteria used in the different phases of operation are different as will be explained in more detail below.

At 205 the activation signal, or "call for heat", is received. In response, the control method performs an ON cycle as follows. At 210, the ignitor ON signal is provided to the fuel oil burner so that the ignitor generates a spark and at 215 the motor ON control signal is provided to the fuel oil burner which will cause the blower and fuel oil pump to begin operation. In one example, the ignitor ON signal and motor ON signal are simply power supplied by the controller 120 to the ignitor and motor, respectively and the ignitor OFF signal and the motor OFF signal are the absence of power being supplied to the ignitor and motor, respectively.

At 220, an optional valve ON delay period is observed prior to providing the valve ON control signal to the fuel oil burner at 225. In one example, the valve ON signal is simply power supplied by the controller 120 to the oil valve 140 and the valve OFF signal is the absence of power being supplied to the oil valve. The valve ON delay period allows the fuel oil pump to build sufficient pressure for proper atomization of the fuel oil as soon as the valve is opened. The valve ON delay period also allows for a period of time during which the blower is moving air through the combustion chamber prior to lighting the burner to perform a "pre-purge" operation. If flame is detected between 205-220, the failsafe feature is activated at 235. In one example the failsafe feature is locking out the fuel oil burner.

After causing the valve to open, at 230 the controller monitors the flame sense signal to determine whether a flame is present in the combustion chamber. There are many different techniques that may be used to sense the presence of flame based on the flame sense signal, the details of which are omitted here for the sake of brevity. If, after the flame detection period has expired, a flame has not yet been detected at 235 the failsafe feature, such as locking out the burner, is activated. If a flame is detected within the detection period at 240 the controller waits an optional ignition carryover delay period before providing the ignitor OFF control signal at 245. At this point in the control method the fuel oil burner system is providing heat in steady state operation. If the controller does not detect flame during operations 225-250, the failsafe feature is activated at 235.

The fuel oil burner system continues to provide heat until at 250 the controller receives a deactivation signal (which may be an affirmative deactivation signal or the absence of the activation signal). In response to the deactivation signal, the control method performs an OFF cycle as follows. At 255 the controller provides the valve OFF signal to stop the flow of fuel oil to the nozzle which will extinguish the flame. At 260 an optional motor OFF delay period is observed in which the motor continues to power the blower so that clean air flushes out the combustion chamber. This motor OFF delay period is sometimes called post-purge and the length of the period may be dependent on the size or flow characteristics of the combustion chamber. At 265, after waiting for expiration of the motor OFF delay period, the controller provides the motor OFF signal. At this point the fuel oil burner is inactive and the controller is monitoring for the activation signal. If flame is detected between 255-265, the failsafe feature may be activated at 235.

Legacy fuel oil burners are designed to detect flame generated by the combustion of fossil fuels. To detect flame fossil fuel oil burners compare the detected light to a threshold value. For the purposes of this description "light" will be used as shorthand for a level of light determined by the fuel oil burner controller based on samples of the flame detection signal (e.g., a signal that is indicative of ambient light near the nozzle of the fuel oil burner). As already discussed, this flame sensing signal may be indicative of the resistance of a cad cell. This resistance will decrease as the level of light increases. It is to be understood that when the term light is used with respect to the controller's determination of the presence of flame, the controller may be directly analyzing the resistance of a cad cell which can be mapped to a quantity or level of light (measured in Lux or Lumens). For simplicity sake, light, rather than cad cell resistance, will be used for this description. The flame sensing signal is sampled to generate a series of light samples taken during consecutive sampling periods. These light samples are analyzed by the controller using flame sensing criteria to determine whether or not a flame is present.

Demand for fuel oil burners that may burn renewable fuels such as biodiesel is increasing. Since the chemical composition of renewable fuels is different from fossil fuels, the properties of flame generated by combustion of renewable fuels may be different from those of fossil fuel flame. Fossil fuel oil burners are programmed with a light threshold that is based on the combustion of fossil fuels. This means that flames generated by renewable fuel, which may be dimmer than fossil fuel flames, may not be sensed by a fossil fuel oil burner controller. To compensate for the dimmer flame of renewable fuels, the light threshold used to detect flame may be lowered. However, lowering the flame detection threshold may cause the controller to erroneously detect flame when none is present based on light from a nearby source.

The following description outlines systems, methods, and circuitries that enable a fuel oil burner controller more reliably detect a flame or the absence of flame even when a lower light threshold is used to accommodate renewable fuels. In some examples, the same flame detection method may be able to detect flame from fossil fuel or renewable fuel.

Many of the described methods will include evaluating one or more light samples indicative of a level of light in a fuel oil burner with respect to a threshold and/or a secondary criteria. This evaluation may include any of a number of techniques, including, but not limited to, the following types of analysis. In some examples, a particular evaluation technique may be identified for the particular example, however it is intended that any evaluation technique may be used.

In one example, a representative value of the one or more light samples may be compared to the flame threshold or evaluated based on the secondary criteria. The representative value may correspond to an average of the values of the one or more light samples, a median value of the values of the one or more light samples, a maximum value of the one or more light samples, or a minimum value of the one or more light samples.

In another example, each of the one or more light samples may be compared to a flame threshold or evaluated based on the secondary criteria. It is determined that the flame threshold is exceeded when each sample exceeds the threshold. It is determined that the secondary criteria is met when each value meets the secondary criteria.

In another example, each of the one or more light samples may be compared to a flame threshold or evaluated based on the secondary criteria. It is determined that the flame threshold is exceeded when values for two or more consecutive samples exceed the threshold. It is determined that the secondary criteria is met when values for two or more consecutive samples meet the secondary criteria.

In another example, each of the one or more light samples may be compared to a flame threshold or evaluated based on the secondary criteria. It is determined that the flame threshold is exceeded when a predetermined percentage of the values exceed the threshold. It is determined that the secondary criteria is met when a predetermined percentage of the values meet the secondary criteria.

Figure 3:
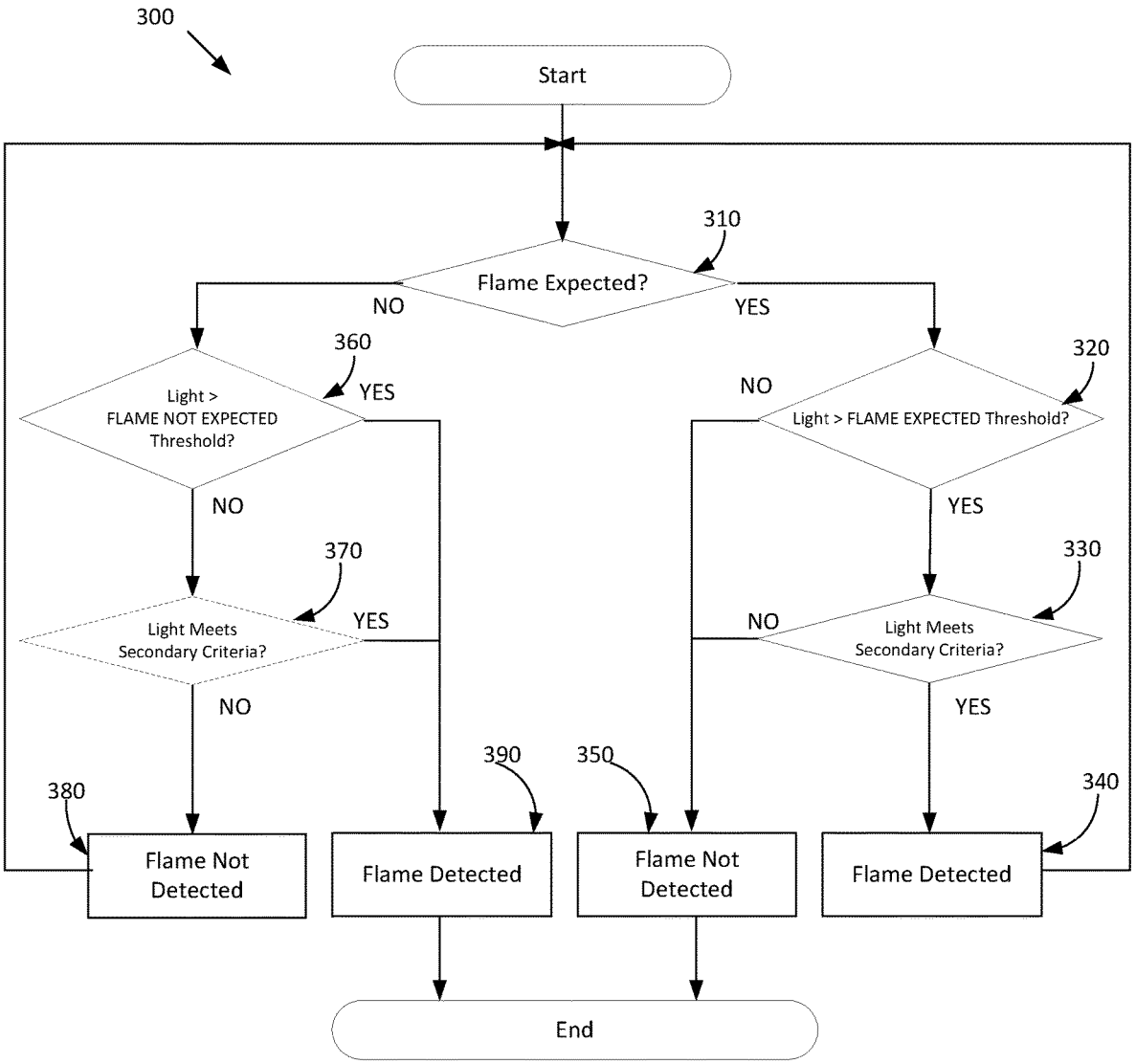
FIG. 3 is a flow diagram outlining an exemplary flame sensing method that includes one or more secondary flame sensing criteria, in accordance with various aspects described.

FIG. 3 is a flow diagram outlining an exemplary method 300 for detecting flame in a fuel oil burner. At 310, a determination is made as to whether a flame is expected. This determination is made based on what point in the ON cycle/OFF cycle the fuel oil burner is operating (see FIG. 2). If a flame is expected, at 320 the light in the burner (e.g., as indicated by the flame sense signal or the values of one or more light samples in a sampling interval) is compared to a flame expected threshold. The flame expected threshold may be set based on an expected amount of light that is exhibited by a flame. If the light does not exceed the flame expected threshold, then the method does not detect a flame when one is expected at 350. The method ends and a failsafe feature may be activated.

If the values of the one or more light samples exceed the flame expected threshold, at 330 a determination is made as to whether the values of the one or more light samples meet secondary criteria. Examples of secondary criteria are described in more detail with reference to FIGS. 6 and 7. One secondary criteria may be based on a comparison between the light in the burner and light measured previously when a flame was present and light measured when a flame was not present. Another secondary criteria may be a deviation based criteria that uses deviation in the light level as a proxy for the flicker of a flame. If the values of the one or more light samples meet the secondary criteria, at 340 a flame is detected when a flame is expected and the method returns to 310 for continued flame monitoring. If the values of the one or more light samples do not meet the secondary criteria, then at 350 the method does not detect a flame when one is expected. The method ends and a failsafe feature may be activated. Thus it can be seen that, in this example, for a flame to be detected when flame is expected the light must meet at least two criteria while if either of the criteria is not met, then a flame will not be detected.

If at 310 it is determined that the controller is operating in a flame not expected mode, at 360 the values of the one or more light samples are compared to a flame not expected threshold. In one example, the flame not expected threshold may be higher than the flame expected threshold. This is to prevent nuisance failsafe activation when ambient light might be interpreted as a flame. If the values of the one or more light samples exceed the flame not expected threshold at 390 flame is detected when no flame is expected. The method ends and a failsafe feature may be activated.

In one example, if the values of the one or more light samples do not exceed the flame not expected threshold, then at 370 the values of the one or more light samples may be evaluated against the same or different secondary criteria as in step 330. If the values of the one or more light samples meet the secondary criteria at 390 flame is detected when no flame is expected. The method ends and a failsafe feature may be activated. If the values of the one or more light samples do not meet the secondary criteria, at 380 a flame is not detected when flame is not expected and the method returns to 310 for continued flame monitoring. Thus it can be seen that, in this example, for a flame to not be detected when flame is not expected the light must fail at least two criteria while if either of the criteria is met, then a flame will be detected.

Figure 4:
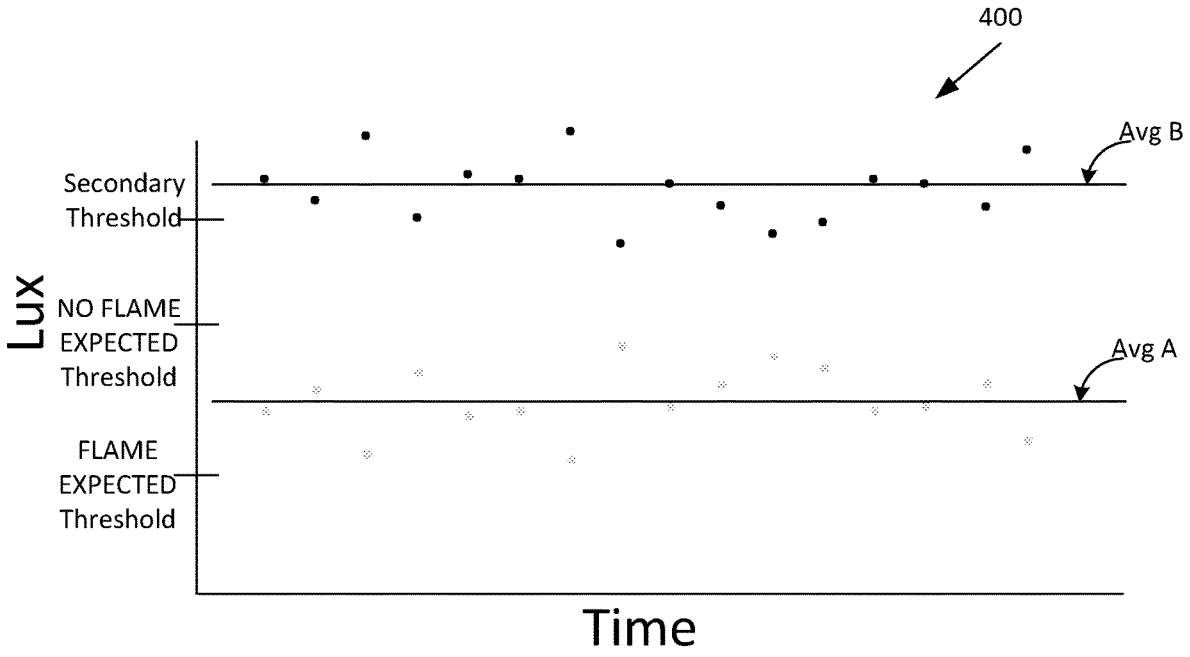
FIG. 4 is a plot depicting sensed light values used to detect the presence of a flame.

FIG. 4 illustrates exemplary light sample values taken over a sampling interval. Three different thresholds are indicated on the y axis. The gray points represent light samples for a renewable fuel flame while the black points represent light samples for fossil fuel flame. It can be seen that the fossil fuel flame burns significantly brighter than the renewable fuel. An average A indicates an average of the renewable fuel flame light sample values in the sample interval. An average B indicates an average of the fossil fuel flame light sample values. A secondary threshold is used as a flicker related secondary criterion as will be described with reference to FIG. 7.

The flame expected threshold is set significantly lower than the light sample values for the fossil fuel flame in order for the flame expected threshold to detect the renewable fuel flame. The no flame expected threshold may be set higher than the flame expected threshold to avoid nuisance detection of flame due to ambient light. However, it is possible that the renewable fuel flame would not exceed the no flame expected threshold which might lead to an unexpected renewable fuel flame going undetected. Thus, as outlined in FIG. 3, one or more secondary criteria are evaluated in order to more accurately determine whether or not a flame is present when a relatively low flame expected threshold is used.

Figure 5:
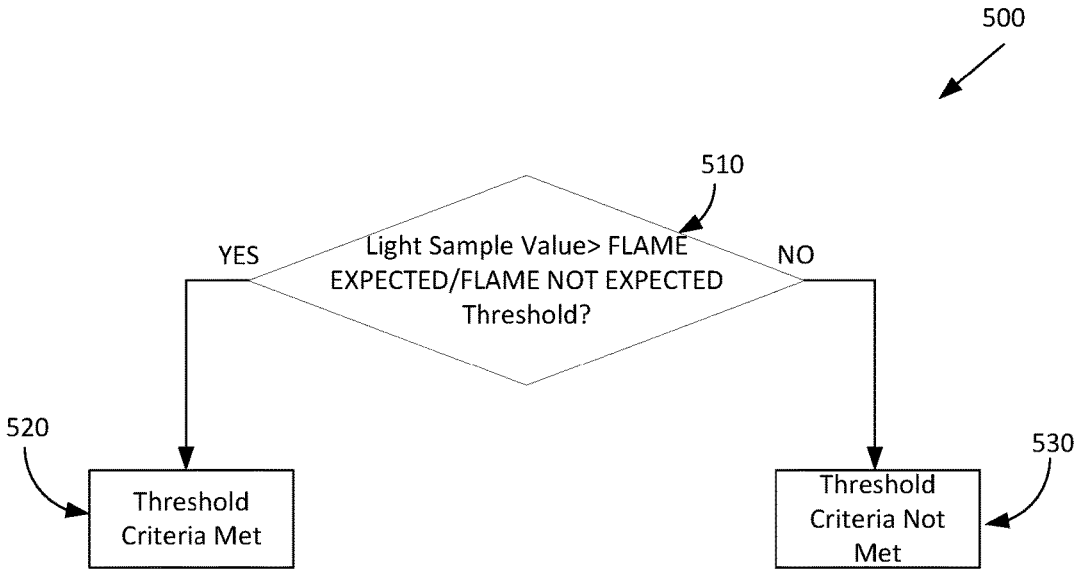
FIG. 5 is a flow diagram outlining an exemplary method for sensing flame based on absolute light levels, in accordance with various aspects described.

FIG. 5 is a flow diagram outlining an exemplary method 500 for detecting flame based on a flame threshold. The method 500 may be performed by the controller 120 of FIG. 1. Recall from FIGS. 3 and 4 that the flame threshold used to detect flame depends on whether a flame is expected or not expected. At 510, the values of the one or more light samples are compared to the appropriate threshold (either flame expected or flame not expected). If the values of the one or more light samples exceed the flame threshold then at 520 the threshold criteria is met. If the values of the one or more light samples do not exceed the appropriate flame threshold, then at 530 the threshold criteria is not met.

Figure 6:
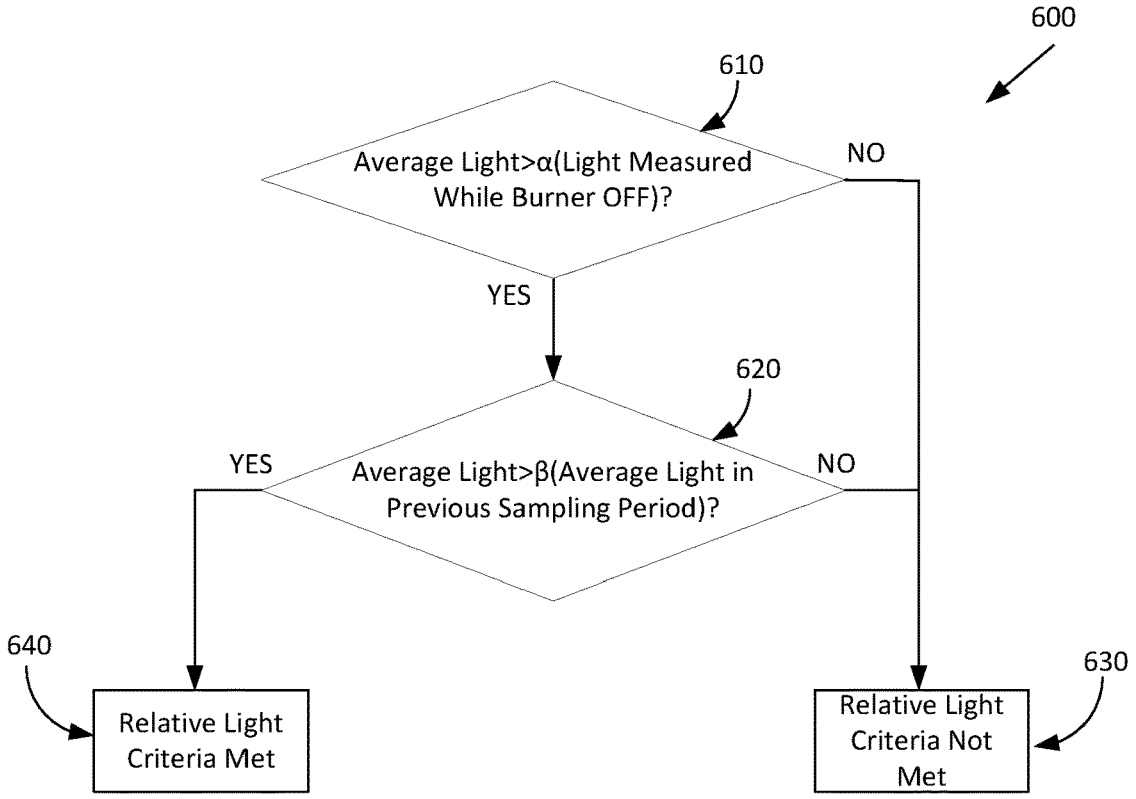
FIG. 6 is a flow diagram outlining an exemplary method for sensing flame based on relative light level, in accordance with various aspects described.
Figure 7:
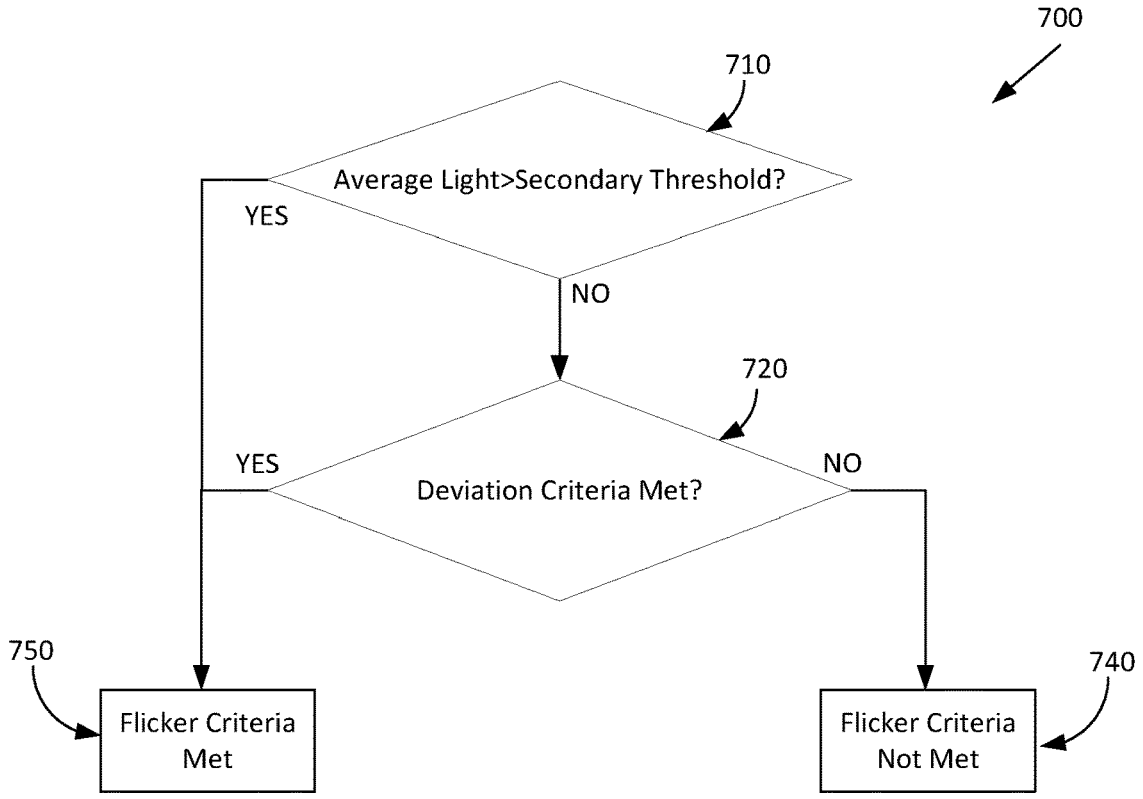
FIG. 7 is a flow diagram outlining an exemplary method for sensing flame based on deviation in light levels, in accordance with various aspects described.

FIGS. 6 and 7 illustrate two different examples of secondary criteria that may be used to detect flame. While these examples are illustrated separately, both examples may be used as secondary criteria in the same detection method. FIG. 6 is a flow diagram outlining an exemplary method for evaluating "relative light" secondary criteria. The method 600 may be performed by the controller 120 of FIG. 1. At 610 a determination is made as to whether the values of the one or more light samples in a sampling interval exceeds a light sample value taken when the burner was OFF by a predetermined margin. This burner OFF light sample value may be the last light sample value taken before a most recent call for heat or some other light sample value taken during a time at which the burner was OFF. In one example the predetermined margin is 50% and a is 1.5 in 610. If the values of the one or more light samples do not exceed the burner OFF light value by the margin, then at 630 the relative light criteria are determined to be not met.

If the values of the one or more light samples exceed the burner OFF light value by the margin, then at 620 a determination is made as to whether the values of the one or more light samples exceed a predetermined portion (indicated as β) of a previous average light value of a previous sampling interval in which flame was detected. In one example 0 is 0.5. If the values of the one or more light samples do not exceed the predetermined portion of the previous average light value, at 630 it is determined that the relative light criteria are not met. If the values of the one or more light samples exceed the predetermined portion of the previous average light value, at 630 it is determined that the relative light secondary criteria are met.

FIG. 7 is a flow diagram outlining an exemplary method for evaluating "flicker related" secondary criteria. The method 700 may be performed by the controller 120 of FIG. 1. At 710 a determination is made as to whether the values of the one or more light samples in a sampling interval exceed a secondary threshold. This secondary threshold may be selected to be indicative of a fossil fuel flame and is higher than the other thresholds used to detect flame (see FIG. 4). Thus, if the values of the one or more light samples exceed the secondary threshold it is fairly certain that there is flame. If the values of the one or more light samples exceed the secondary threshold, at 750 the flicker related secondary criteria are determined to be met.

If the values of the one or more light samples do not exceed the secondary threshold, then at 720 a determination is made as to whether deviation criteria are met. In one example, the deviation criteria include at least one light sample value in the sampling interval deviating from the average light sample value in the sampling interval by at least some amount. In one example, the deviation amount is 3%. If the deviation criteria are not met then at 740 it is determined that the flicker related secondary criteria are not met. If the deviation criteria are met then at 750 it is determined that the flicker related secondary criteria are met.

In one example, the flame detection method evaluates the threshold criteria (FIG. 5), relative light criteria (FIG. 6), and flicker related criteria (FIG. 7) to detect flame. When flame is expected, all three criteria must be met to detect flame and if any criteria is not met, flame is not detected. Likewise when flame is not expected, all of the criteria must fail for flame to not be detected while if any criteria are met then flame will be detected.

It can be seen from the foregoing description that the described flame sensing methods that employ secondary criteria for detecting flame improve the reliability of flame detection in fuel oil burners that burn fossil or renewable fuels.

While the invention has been illustrated and described with respect to one or more implementations, alterations and/or modifications may be made to the illustrated examples without departing from the spirit and scope of the appended claims. In particular regard to the various functions performed by the above described components or structures (assemblies, devices, circuits, circuitries, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention.

In the present disclosure like reference numerals are used to refer to like elements throughout, and wherein the illustrated structures and devices are not necessarily drawn to scale. As utilized herein, terms "module", "component," "system," "circuit," "circuitry," "element," "slice," and the like are intended to refer to a computer-related entity, hardware, software (e.g., in execution), and/or firmware. For example, circuitry or a similar term can be a processor, a process running on a processor, a controller, an object, an executable program, a storage device, and/or a computer with a processing device. By way of illustration, an application running on a server and the server can also be circuitry. One or more circuitries can reside within a process, and circuitry can be localized on one computer and/or distributed between two or more computers. A set of elements or a set of other circuitry can be described herein, in which the term "set" can be interpreted as "one or more."

As another example, circuitry or similar term can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, circuitry can be an apparatus that provides specific functionality through electronic components without mechanical parts; the electronic components can include field gates, logical components, hardware encoded logic, register transfer logic, one or more processors therein to execute software and/or firmware that confer(s), at least in part, the functionality of the electronic components.

It will be understood that when an element is referred to as being "electrically connected" or "electrically coupled" to another element, it can be physically connected or coupled to the other element such that current and/or electromagnetic radiation can flow along a conductive path formed by the elements. Intervening conductive, inductive, or capacitive elements may be present between the element and the other element when the elements are described as being electrically coupled or connected to one another. Further, when electrically coupled or connected to one another, one element may be capable of inducing a voltage or current flow or propagation of an electro-magnetic wave in the other element without physical contact or intervening components. Further, when a voltage, current, or signal is referred to as being "applied" to an element, the voltage, current, or signal may be conducted to the element by way of a physical connection or by way of capacitive, electro-magnetic, or inductive coupling that does not involve a physical connection.

Use of the word exemplary is intended to present concepts in a concrete fashion. The terminology used herein is for the purpose of describing particular examples only and is not intended to be limiting of examples. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein the term "or" includes the option of all elements related by the word or. For example A or B is to be construed as include only A, only B, and both A and B. Further the phrase "one or more of" followed by A, B, or C is to be construed as including A, B, C, AB, AC, BC, and ABC.

What is claimed is:

1. A controller for a fuel oil burner system that controls a fuel oil burner to perform intermittent ON cycles and OFF cycles, the controller comprising a processor configured to:

receive a series of one or more light samples from the fuel oil burner, wherein values of the one or more light samples are indicative of a level of light in the fuel oil burner;

determine whether the fuel oil burner is operating in a flame expected mode or a flame not expected mode;

select a first threshold when the fuel oil burner is operating in the flame expected mode or select a second threshold when the fuel oil burner is operating in the flame not expected mode, wherein the first threshold is different from the second threshold; and when the fuel oil burner is operating in the flame expected mode, determine whether the values of the one or more of the light samples exceed the first threshold; and determine whether the values of the one or more of the light samples meet secondary criteria;

determine that a flame is present when the values of the one or more light samples exceed the first threshold and meet the secondary criteria; and determine that a flame is not present when the values of the one or more light samples are below the first threshold or do not meet the secondary criteria, and when the fuel oil burner is operating in the flame not expected mode, determine whether the values of the one or more light samples exceed the second threshold; and determine that a flame is present when the values of the one or more light samples exceed the second threshold.

2. The controller of claim 1, wherein the processor is configured to, when the fuel oil burner is operating in the flame not expected mode:

determine that a flame is not present when the values of the one or more light samples are below the second threshold.

3. The controller of claim 2, wherein the first threshold is higher than the second threshold.

4. The controller of claim 1, wherein the processor is configured to, when the controller is operating in the flame not expected mode:

determine whether the values of the one or more of the light samples meet the secondary criteria;

determine that a flame is present when the values of the one or more light samples meet the secondary criteria; and determine that a flame is not present when the values of the one or more light samples do not meet the secondary criteria.

5. The controller of claim 1, wherein the processor is configured to determine whether the values of the one or more light samples meet the secondary criteria by:

determining whether the values of the one or more light samples exceed, by a predetermined margin, a burner OFF light sample value taken when the fuel oil burner is in an OFF cycle;

determining that the secondary criteria is met when the values of the one or more light samples exceed the burner OFF light sample value by the predetermined margin; and determining that the secondary criteria is not met when the values of the one or more light samples do not exceed the burner OFF light value by the predetermined margin.

6. The controller of claim 1, wherein the processor is configured to determine whether the values of the one or more light samples meet the secondary criteria by:

determining whether the values of the one or more light samples exceed a predetermined portion of a previous representative value of one or more previous light samples;

determining that the secondary criteria is met when the values of the one or more light samples exceed the predetermined portion of the previous representative value; and determining that the secondary criteria is not met when the values of the one or more light samples do not exceed the predetermined portion of the previous representative value.

7. The controller of claim 1, wherein the processor is configured to determine whether the values of at least two of the one or more light samples meet the secondary criteria based on a deviation criteria that specifies a minimum amount of deviation between the values of the one or more light samples.

8. A controller for a fuel oil burner system that controls a fuel oil burner to perform intermittent ON cycles and OFF cycles, the controller comprising a processor configured to:

receive a series of one or more light samples from the fuel oil burner, wherein values of the one or more light samples are indicative of a level of light in the fuel oil burner;

determine whether the values of the one or more of the light samples exceed a flame threshold;

determine whether the values of the one or more light samples meet a secondary criteria by:

determining whether the values of the one or more light samples exceeds a secondary threshold;

determining whether a deviation criteria that specifies a minimum amount of deviation between the values of at least two of the one or more light samples is met by the one or more light samples;

determining that the secondary criteria is met when the values of the one or more light samples exceed the secondary threshold or the values of at least two of the one or more light samples meet the deviation criteria; and determining that the secondary criteria is not met when the values of the one or more light samples are below the secondary threshold and at least two of the one or more light samples do not meet the deviation criteria; and determine whether a flame is present based on whether the values of the one or more light samples exceed the flame threshold or meet the secondary criteria.

9. The controller of claim 8, wherein the secondary threshold is higher than the flame threshold and a no flame threshold.

10. A method configured to control a fuel oil burner to perform intermittent ON cycles and OFF cycles, comprising:

receiving a series of one or more light samples from the fuel oil burner, wherein values of the one or more light samples are indicative of a level of light in the fuel oil burner;

determining whether the fuel oil burner is operating in a flame expected mode or a flame not expected mode;

selecting a first threshold when the fuel oil burner is operating in the flame expected mode or selecting a second threshold when the fuel oil burner is operating in the flame not expected mode, wherein the first threshold is different from the second threshold;

when the fuel oil burner is operating in the flame expected mode, determining whether the values of the one or more of the light samples exceed the first threshold; and determining whether the values of the one or more of the light samples meet secondary criteria;

determining that a flame is present when the values of the one or more light samples exceed the first threshold and meet the secondary criteria; and determining that a flame is not present when the values of the one or more light samples are below the first threshold or do not meet the secondary criteria; and when the fuel oil burner is operating in the flame not expected mode:

determining whether the values of the one or more of the light samples exceed the second threshold; and determining that a flame is present when the values of the one or more light samples exceed the second threshold.

11. The method of claim 10, further comprising, when the fuel oil burner is operating in the flame not expected mode:

determining that a flame is not present when the values of the one or more light samples are below the second threshold.

12. The method of claim 11, wherein the first threshold is lower than the second threshold.

13. The method of claim 10, further comprising, when the fuel oil burner is operating in the flame not expected mode:

determining whether the values of the one or more of the light samples meet the secondary criteria;

determining that a flame is present when the values of the one or more light samples meet the secondary criteria; and determining that a flame is not present when the values of the one or more light samples do not meet the secondary criteria.

14. The method of claim 10, further comprising determining whether the values of the one or more light samples meet the secondary criteria by:

determining whether the values of the one or more light samples exceed, by a predetermined margin, a burner OFF light sample value taken when the fuel oil burner is in an OFF cycle;

determining that the secondary criteria is met when the values of the one or more light samples exceed the burner OFF light sample value by the predetermined margin; and determining that the secondary criteria is not met when the values of the one or more light samples do not exceed the burner OFF light value by the predetermined margin.

15. The method of claim 10, further comprising determining whether the values of the one or more light samples meet the secondary criteria by:

determining whether the values of the one or more light samples exceed a predetermined portion of a previous representative value of one or more previous light samples;

determining that the secondary criteria is met when the values of the one or more light samples exceed the predetermined portion of the previous representative value; and determining that the secondary criteria is not met when the values of the one or more light samples do not exceed the predetermined portion of the previous representative value.

16. The method of claim 10, further comprising determining whether the values of at least two of the one or more light samples meet the secondary criteria based on a deviation criteria that specifies a minimum amount of deviation between the values of the one or more light samples.

17. The method of claim 16, further comprising determining whether the values of the one or more light samples meet the secondary criteria by:

determining whether the values of the one or more light samples exceeds a secondary threshold;

determining whether the deviation criteria is met by at least two of the one or more light samples;

determining that the secondary criteria is met when the values of the one or more light samples exceed the secondary threshold or the values of at least two of the one or more light samples meet the deviation criteria; and determining that the secondary criteria is not met when the values of the one or more light samples are below the secondary threshold and at least two of the one or more light samples do not meet the deviation criteria.

18. The method of claim 17, wherein the secondary threshold is higher than the first threshold and the second threshold.

* * * * *